US008011024B2

(12) United States Patent
Newman

(10) Patent No.: US 8,011,024 B2
(45) Date of Patent: Sep. 6, 2011

(54) ODOR ABSORBING SYSTEM AND METHOD

(75) Inventor: Anthony E. Newman, Shakopee, MN (US)

(73) Assignee: Sunburst Companies, Inc., Shakopee, MN (US)

( * ) Notice: Subject to any disclaimer, the term of this patent is extended or adjusted under 35 U.S.C. 154(b) by 884 days.

(21) Appl. No.: 11/858,617

(22) Filed: Sep. 20, 2007

(65) Prior Publication Data

US 2008/0016603 A1 Jan. 24, 2008

Related U.S. Application Data

(63) Continuation of application No. 11/881,083, filed on Jul. 25, 2007, now Pat. No. 7,934,268, which is a continuation of application No. 11/024,510, filed on Dec. 29, 2004, now Pat. No. 7,260,853.

(60) Provisional application No. 60/580,303, filed on Jun. 16, 2004.

(51) Int. Cl.
*A42B 1/04* (2006.01)

(52) U.S. Cl. ..... 2/206; 2/69; 2/202

(58) Field of Classification Search ..... 2/1, 69, 2/94, 202, 243.1, 93, 206, 203, 410, 424, 2/171.5, 423; 128/201.25, 205.27
See application file for complete search history.

(56) References Cited

U.S. PATENT DOCUMENTS

| | | | | |
|---|---|---|---|---|
| 2,030,360 A | | 2/1936 | Dyer | |
| 2,615,754 A | | 10/1952 | Lindenberg | 239/36 |
| 2,626,689 A | | 1/1953 | Davis et al. | |
| 2,719,976 A | | 10/1955 | Sussman | 450/104 |
| 3,333,585 A | | 8/1967 | Barghini et al. | 128/212 |
| 3,717,882 A | * | 2/1973 | Schuessler | 2/173 |
| 3,789,839 A | * | 2/1974 | Lund et al. | 128/201.25 |
| 3,922,723 A | | 12/1975 | Popper | 2/113 |
| 4,228,549 A | | 10/1980 | Rispoli | 2/239 |
| 4,231,118 A | * | 11/1980 | Nakagawa | 2/7 |
| 4,244,059 A | | 1/1981 | Phlaumer | 2/400 |
| 4,285,068 A | * | 8/1981 | Ross | 2/202 |
| 4,285,468 A | | 8/1981 | Hyman | 239/55 |
| 4,433,024 A | | 2/1984 | Eian | 428/198 |
| 4,520,509 A | * | 6/1985 | Ward | 2/206 |
| 4,534,976 A | | 8/1985 | Hansen et al. | |
| 4,539,982 A | | 9/1985 | Bailly | 128/156 |

(Continued)

FOREIGN PATENT DOCUMENTS

WO WO 2005/032289 A2 4/2005

OTHER PUBLICATIONS

Office Action from related U.S. Appl. No. 11/881,083, mailed Aug. 13, 2010.

*Primary Examiner* — Katherine Moran
*Assistant Examiner* — Richale L Quinn
(74) *Attorney, Agent, or Firm* — Westman, Champlin & Kelly, P.A.

(57) ABSTRACT

An odor absorbing system includes a head covering article of clothing configured to be worn by a person. The head covering article of clothing includes a base layer comprising a cap section configured to substantially cover a head of the person wearing the article of clothing. An odor absorbing insert is removable attachable to the article of clothing.

19 Claims, 11 Drawing Sheets

U.S. PATENT DOCUMENTS 4,663,780 A 5/1987 Rawlings et al. ..... 2/53
4,810,102 A 3/1989 Norton ..... 383/4
4,826,497 A 5/1989 Marcus et al. ..... 604/359
4,872,220 A 10/1989 Haruvy et al. ..... 2/243
5,025,507 A * 6/1991 Kirby ..... 2/206
5,042,088 A * 8/1991 Sherrod et al. ..... 2/53
5,058,211 A * 10/1991 Hanks ..... 2/206
5,074,439 A 12/1991 Wilcox
5,112,666 A 5/1992 Langston ..... 428/104
5,122,407 A 6/1992 Yeo et al. ..... 428/138
5,159,718 A 11/1992 Moyer ..... 2/69
5,197,208 A 3/1993 Lapidus ..... 36/43
5,326,305 A 7/1994 Fochler ..... 450/57
5,383,236 A * 1/1995 Sesselmann ..... 2/243.1
5,511,541 A * 4/1996 Dearstine ..... 128/201.13
5,539,930 A * 7/1996 Sesselmann ..... 2/243.1
5,593,398 A 1/1997 Weimer ..... 604/359
5,628,308 A * 5/1997 Harges et al. ..... 128/206.21
5,636,628 A * 6/1997 Barnum ..... 128/206.12
5,678,247 A * 10/1997 Vickers ..... 2/69
5,697,105 A * 12/1997 White ..... 2/206
5,761,747 A 6/1998 Eagleson
5,790,987 A * 8/1998 Sesselmann ..... 2/243.1
5,809,577 A 9/1998 Getz ..... 2/406
6,000,057 A * 12/1999 Newman ..... 2/69
6,009,559 A * 1/2000 Sesselmann ..... 2/243.1
6,070,578 A * 6/2000 Baughman et al. ..... 128/205.27
6,073,772 A 6/2000 Forbes et al.
6,134,716 A * 10/2000 Richardson ..... 2/202
6,134,718 A 10/2000 Sesselmann ..... 2/243.1
6,313,371 B1 11/2001 Conant et al.
6,338,340 B1 * 1/2002 Finch et al. ..... 128/205.27
6,348,423 B1 2/2002 Griffiths et al. ..... 442/123
6,561,355 B1 5/2003 Forbes et al.
6,584,976 B2 * 7/2003 Japuntich et al. ..... 128/206.15
6,632,499 B1 * 10/2003 Marks et al. ..... 428/42.1
7,062,788 B2 * 6/2006 Tremblay-Lutter et al. ..... 2/69
7,107,628 B2 * 9/2006 Haaga ..... 2/457
7,152,252 B2 * 12/2006 Gellis et al. ..... 2/206
7,260,853 B2 8/2007 Newman
7,328,789 B2 2/2008 Bohanan et al.
2001/0010098 A1 8/2001 Polegato Moretti ..... 2/97
2002/0023651 A1 * 2/2002 Japuntich et al. ..... 128/206.15
2002/0069904 A1 6/2002 Robinson
2003/0152501 A1 8/2003 Byrd et al.
2004/0107474 A1 * 6/2004 Sesselmann ..... 2/69
2005/0262620 A1 * 12/2005 Li et al. ..... 2/455
2005/0278820 A1 * 12/2005 Newman ..... 2/69
2006/0147698 A1 7/2006 Carroll et al.
2006/0162048 A1 * 7/2006 Blutstein ..... 2/202
2006/0191058 A1 * 8/2006 Huza ..... 2/239
2006/0212997 A1 * 9/2006 Blanchard ..... 2/239
2007/0092479 A1 * 4/2007 Turriff ..... 424/76.2
2007/0151122 A1 * 7/2007 Pestrue et al. ..... 36/7.3
2007/0151877 A1 * 7/2007 Newman ..... 206/278
2007/0226868 A1 * 10/2007 Hunt ..... 2/69
2007/0243239 A1 * 10/2007 Lanser ..... 424/448
2008/0028494 A1 * 2/2008 Newman ..... 2/94
2008/0184996 A1 * 8/2008 Colorado ..... 128/201.25
2009/0114228 A1 * 5/2009 Kirschner ..... 128/206.13
2009/0139003 A1 6/2009 Lee
2010/0076532 A1 * 3/2010 Matich ..... 607/109
2010/0107991 A1 * 5/2010 Elrod et al. ..... 119/712

* cited by examiner

ODOR ABSORBING SYSTEM AND METHOD

The present application is a Continuation of U.S. patent application Ser. No. 11/881,083, entitled "ODOR ABSORBING SYSTEM AND METHOD," filed Jul. 25, 2007 now U.S. Pat. No. 7,934,268, which is a Continuation of U.S. patent application Ser. No. 11/024,510, entitled "ODOR ABSORBING SYSTEM AND METHOD," filed Dec. 29, 2004 now U.S. Pat. No. 7,260,853, which in turn claims the benefit of U.S. provisional patent application Ser. No. 60/580,303, filed Jun. 16, 2004. The content of the above referenced applications are hereby incorporated by reference in their entirety.

FIELD OF THE INVENTION

The present invention generally relates to an odor absorbing system configured to reduce odor emanation from a person into an environment surrounding the person and, more particularly, to an odor absorbing system that includes an article of clothing and at least one odor absorbing insert that is removably attachable to the article of clothing. Additional aspects of the present invention are directed to methods of using the system.

BACKGROUND OF THE INVENTION

Outdoorsmen and women, particularly hunters, often take steps to prevent their detection by wildlife. Such steps include making themselves less visibly detectable to wildlife by, for example, hiding in a tree-stand or wearing camouflaging clothing.

Such wildlife detection preventing methods also include reducing the likelihood of being detected by scent. For example, animals positioned downwind of the person can easily smell bodily odors including natural body secretions. Other bodily odors that are detectable by animals include odors resulting from soaps, perfumes, shampoos, deodorants and other products that are applied to the body. Other strong animal-detectable odors include those embedded in our clothes that are acquired from the environment, such as cigarette smoke, odors from a cleaning detergent or fabric softener applied to the clothes when washed, and other odors.

Articles of clothing have been developed to prevent odor emanation from the person wearing the article of clothing. Examples of such articles of clothing are described in U.S. Pat. Nos. 5,383,236, 5,539,930, 5,790,987, 6,009,559 and 6,134,718 (hereinafter "Sesselmann patents"). Briefly, the patents describe articles of clothing that are formed of a base layer on which a scent absorbing means is "provided" by bonding a scent absorbing agent to a surface of the base layer through a silk-screen printing process.

The Sesselmann patents incorrectly claim that when the scent absorbing means is activated charcoal, it may be reactivated merely by machine washing and drying the article of clothing. However, reactivation of activated charcoal requires a much more complicated process that cannot be performed by washing or drying machines. Instead, the only way to "reactivate" activated charcoal is through a process called pyrolysis in which the activated charcoal is heated to over 1400° F. (800° C.) in a controlled atmosphere of low oxygen.

Accordingly, the useful scent absorbing lifespan of the activated charcoal is limited and basically non-renewable. the process used to renew the activated charcoal is generally too complicated to be performed by non-renewable for those who lack the equipment needed to perform the pyrolysis operation. More particularly, the rate at which the activated charcoal absorbs odors decreases with use to a point where it is no longer useful for scent absorbing purposes. As a result, the entire scent absorbing clothing described in the Sesselmann patents must periodically be replaced in order to maintain the desired scent absorbing performance.

Additionally, since the scent absorbing agent is bonded directly to the base layer that forms the article of clothing, the scent absorbing performance of the article of clothing will decrease during the manufacture and transportation of the odor absorbing base layer material and the article of clothing that is formed of the odor absorbing base layer material. For instance, the odor absorbing base layer material that is ultimately used to form the article of clothing is typically transported in a manner that exposes the material to odors in the environment. Additionally, once the odor absorbing base layer material is received by the manufacturer of the article of clothing, the material is further exposed to odors. Such near continuous exposure to odors decreases the useable odor absorbing lifespan of the base layer material and the article of clothing that is formed of the material.

Furthermore, the articles of clothing of the Sesselmann patents are also likely to be exposed to odors during periods of nonuse. For example, articles of clothing in the form of jackets or pants that are formed of the scent absorbing base layer material are typically exposed to odors in the closet or drawer, in which they are stored during periods of non-use. As a result, the useful scent absorbing lifespan of the clothing continues to decrease even while it is not being worn.

A continuing need exists for ways to reduce personal odor emanation during outdoor activities, such as hunting, while avoiding the waste associated with odor absorbing clothing of the prior art that must be periodically replaced to maintain a desired level of odor absorbing performance.

SUMMARY OF THE INVENTION

Embodiments of the present invention include an odor absorbing system for use by a person to reduce odor emanation from the person into an environment surrounding the person. One embodiment of the system includes a head covering article of clothing configured to be worn by a person. The head covering article of clothing includes a base layer comprising a cap section configured to substantially cover a head of the person wearing the article of clothing. The system also includes an odor absorbing insert that is removable attachable to the article of clothing and includes an odor absorbing agent.

Another embodiment of the present invention is directed to a method of reducing odor emanation from a person into an environment surrounding the person while hunting. In the method, a head covering article of clothing is provided that is configured to be worn by the person. The article of clothing includes a head base layer comprising a cap section. A first odor absorbing insert comprising an odor absorbing agent in a sealed container is provided. The first odor absorbing insert is removed from the sealed container then removably attached to the head covering article of clothing. The head covering article of clothing is then worn by a person including surrounding a head of the person with the cap section of the head covering base layer. Finally, the person hunts wildlife while wearing the article of clothing.

Other features and benefits that characterize embodiments of the present invention will be apparent upon reading the following detailed description and review of the associated drawings.

DETAILED DESCRIPTION OF THE PREFERRED EMBODIMENTS

Figure 1A:
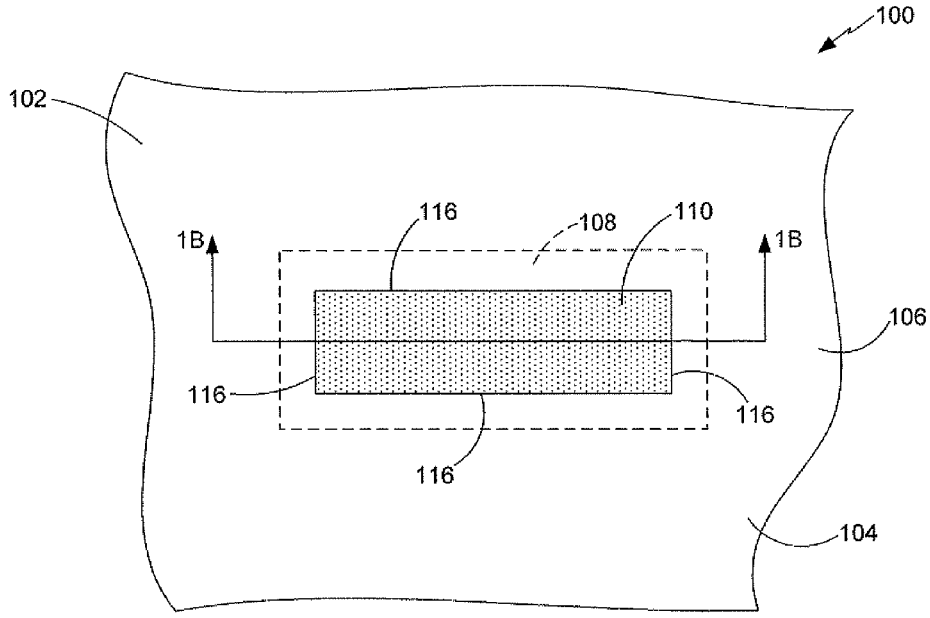
FIG. 1A is a front plan view of a portion of an odor absorbing system in accordance with embodiments of the invention.
Figure 1B:
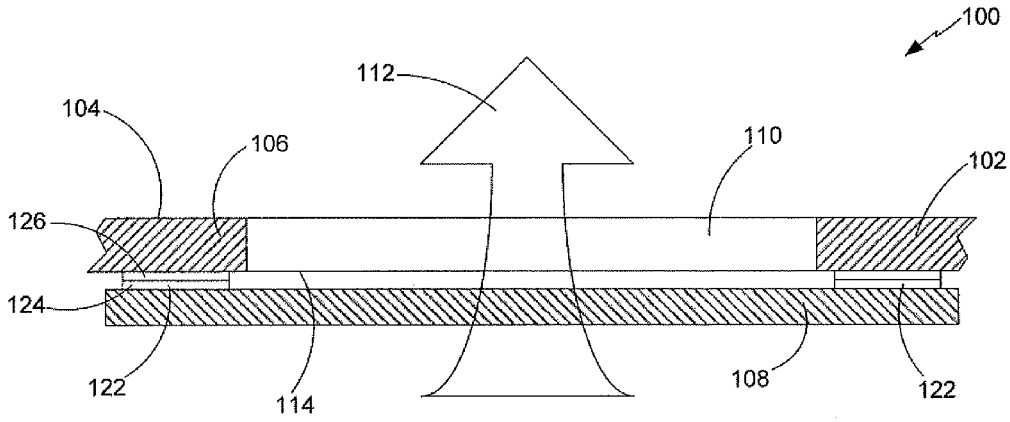
FIG. 1B is a cross-sectional view of the system depicted in FIG. 1A taken generally along the line 1B-1B.

The present invention is generally directed to an odor absorbing system 100, shown in FIGS. 1A and 1B, for use by a person to reduce odor emanation from the person into an environment surrounding the person. FIG. 1A is a partial front plan view of the system 100 in accordance with embodiments of the invention. FIG. 1B is a cross-sectional view of the system 100 depicted in FIG. 1A taken generally along line 1B-1B.

The system 100 includes an article of clothing 102, an exterior side 104 of which is shown in FIG. 1, that includes a base layer 106 that is configured to substantially surround a portion of the person wearing the article of clothing 102. In other words, the base layer 106 forms the body covering structure of the article of clothing 102. Additionally, the system 100 includes at least one odor absorbing insert 108 that is configured to cover at least one vent 110 in the base layer 106 of the article of clothing 102. The odor absorbing insert 108 is configured to adsorb or absorb odors emanating from the person to prevent them from entering the environment surrounding the person. Hereinafter, the tetra "absorb" will be used to describe both adsorbing and absorbing functions.

Preferably, the odor absorbing inserts 108 and vents 110 are positioned on the article of clothing 102 such that, when the article of clothing 102 is worn by a person, they are likely to be positioned adjacent to primary odor-producing areas of the body. Examples of primary odor-producing areas include the armpits, the shoulders, the neck, the crotch area, and the mouth of the person.

Each vent 110 allows for an airflow 112 (outgoing airflow) to be directed through a specific location of the base layer 106 where the odor absorbing insert 108 is placed. As a result, outgoing airflows 112 are directed through the vent 110 and the odor absorbing insert 108 covering the vent 110 which absorbs odors in the airflow 112 to thereby reduce odor emanation from the person wearing the article of clothing 102 into the surrounding environment.

It should be understood that the term "vent", as used herein, is intended to describe an opening through the base layer 106 whose purpose is to allow air to flow from inside the article of clothing 102 to the outside environment, when the article of clothing 102 is worn by a person. Thus, for example, when the article of clothing 102 is in the form of a jacket and is being worn by a person, the vent 110 within the base layer 106 allows the airflow 112 to pass between an interior side 114 of the base layer 106 that is closest to the person's body and the environment that is on the exterior side 104 of the base layer 106 that is opposite the interior side 114.

However, the vent 110 of the present invention is distinguishable from a primary opening that is configured to accommodate a pass-through for a portion of the person wearing the article of clothing. For example, a primary opening at a neckline of an article of clothing in the form of a jacket is not a "vent" as the term is used herein since the opening at the neckline accommodates the neck of the person wearing the jacket. Similarly, a waistline of the jacket that is configured to accommodate a waist of the person wearing the jacket is not a "vent" as the term is used herein. Other examples of non-vent or primary openings in articles of clothing include the opening at a cuff of a sleeve of a shirt or jacket, a waistline of pants, and a cuff at the end of a pant leg.

Figure 2A:
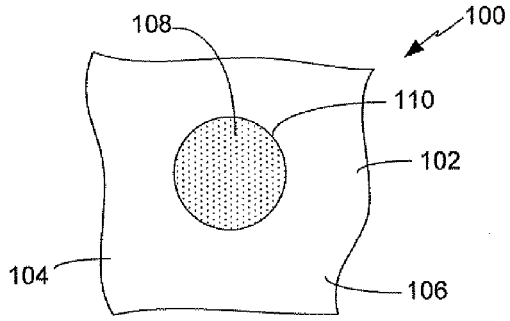
FIGS. 2A-2E illustrate vents in a base layer of an article of clothing of the odor absorbing system in accordance with embodiments of the invention.
Figure 2B:
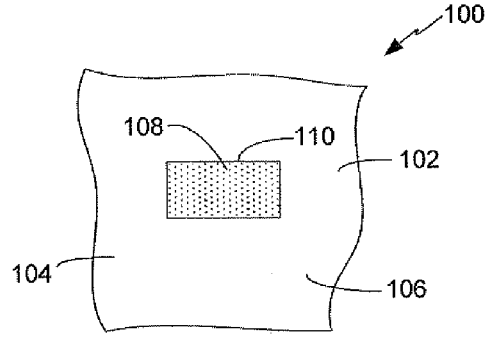
Figure 2C:
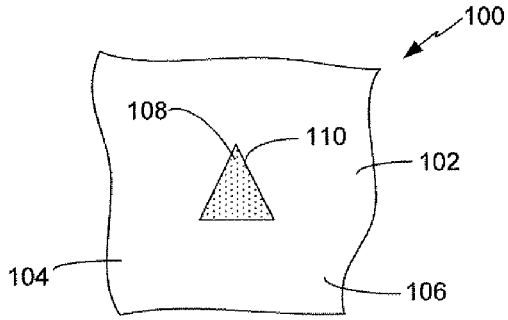
Figure 2D:
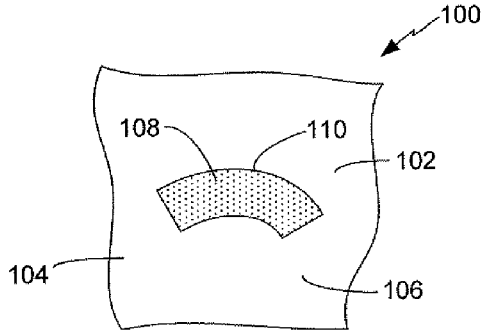
Figure 2E:
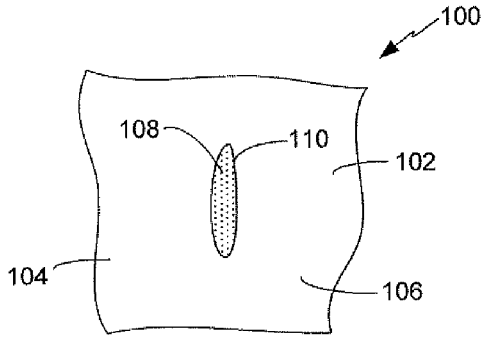

The shape of the vents 110 of the system 100 of the present invention can vary depending on their location. In accordance with one embodiment of the invention, the vents 110 include sides, generally designated as 116, that are displaced from each other when the base layer 106 is laid flat. In other words, one embodiment of the vents 110 of the present invention are formed by removing a portion of the base layer 106 rather than simply making a slit in the base layer 106. The vents 110 can be any desired shape including rectangular (FIG. 2A), circular (FIG. 2B), triangular (FIG. 2C), irregular (FIG. 2D), symmetrical, or other shape. In accordance with another embodiment of the invention, at least one of the vents 110 is formed by making a slit in the base layer 106, as illustrated in FIG. 2E. In accordance with one embodiment of the invention, a breathable material (not shown), such as a mesh, spans the vent and is attached to the sides 116 of the base layer 106.

Figure 3:
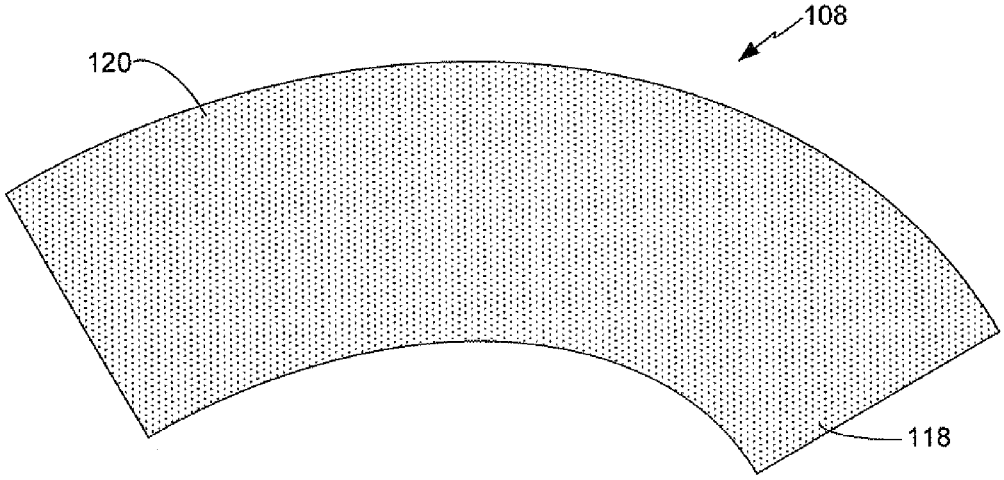
FIG. 3 is a top plan view of an odor absorbing insert in accordance with embodiments of the invention.

FIG. 3 is a top plan view of an odor absorbing insert 108 in accordance with embodiments of the invention. In general, the odor absorbing insert 108 is configured to cover the vent 110 in the base layer 106, as illustrated in FIGS. 1A and 1B. Although depicted as covering the interior side 114 (FIG. 1B) of the vent 110, the odor absorbing insert 108 could be positioned to cover the exterior side 104 of the vent 110 in the base layer 106.

The odor absorbing inserts 108 can be formed of any desirable shape and is sized to preferably cover the entire vent 110. The odor absorbing insert 108 generally includes a layer of breathable material 118 on which an odor absorbing agent 120 is applied. The layer of breathable material 118 includes a substantially porous material through which an airflow (such as airflow of FIG. 1) can easily travel. Embodiments of the layer of breathable material include a mesh, cotton, polypropylene, wool, polyester, or other breathable fabric or material.

The odor absorbing agent 120 is preferably bonded to one or more surfaces of the layer of breathable material 118 in accordance with known methods. The odor absorbing agent 108 preferably includes activated carbon or charcoal. Alternatively, the odor absorbing agent 120 can be formed of other known odor absorbing materials, such as chlorophyll, baking soda, activated alumni, soda, lime, zeolite, calcium oxide, potassium permanganate, and cyclodextrin.

In accordance with one embodiment of the invention, the odor absorbing insert 108 is configured for removable attachment to the base layer 106 of the article of clothing 102 at the vent 110. For instance, the odor absorbing insert 108 can be attached directly to the base layer 106 of the article of clothing 102 at the vent 110 as shown in FIG. 1B using one or more conventional fasteners 122. For example, a plurality of fasteners 122 can be provided each having one portion 124 attached to the odor absorbing insert 108, and another portion 126 attached to the base layer 106 of the article of clothing 102 at the perimeter of the vent 110. Examples of suitable fasteners include hook and loop fasteners (e.g., Velcro®, buttons, zippers, or other suitable fasteners), which allow for the removal of the odor absorbing insert 108 without damaging the article of clothing 102.

Figure 4A:
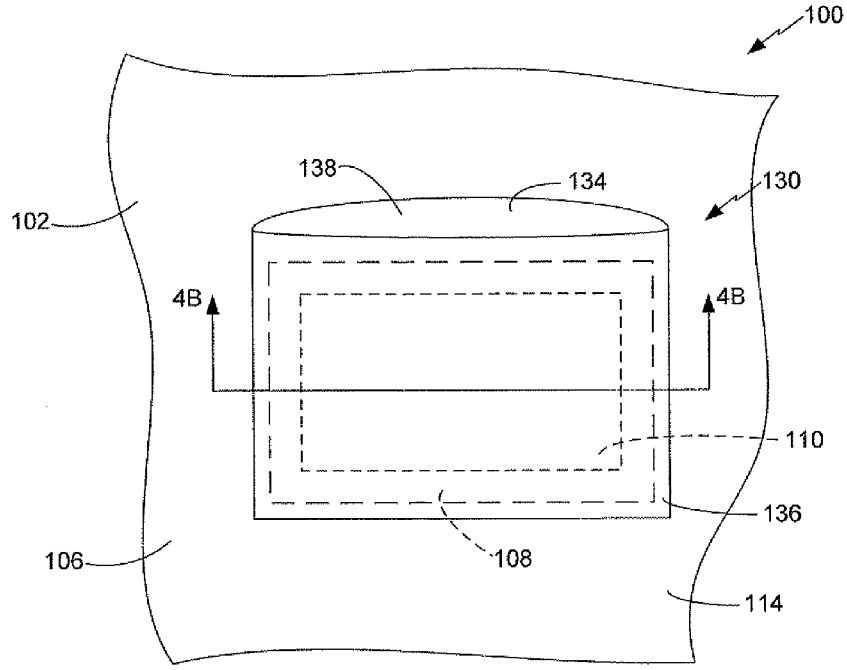
FIG. 4A is a front plan view of an interior side of a portion of an article of clothing of the odor absorbing system in accordance with embodiments of the invention.
Figure 4B:
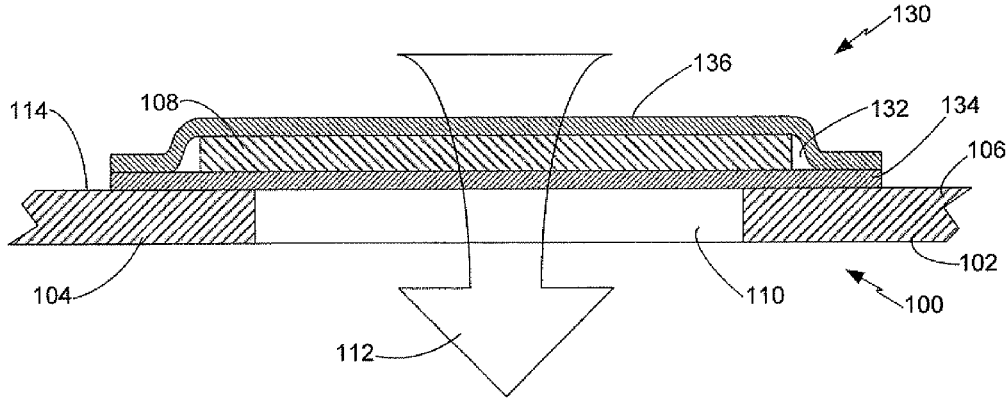
FIGS. 4B and 4C are cross-sectional views of embodiments of the system taken generally along lines 4B-4B of FIG. 4A.
Figure 4C:
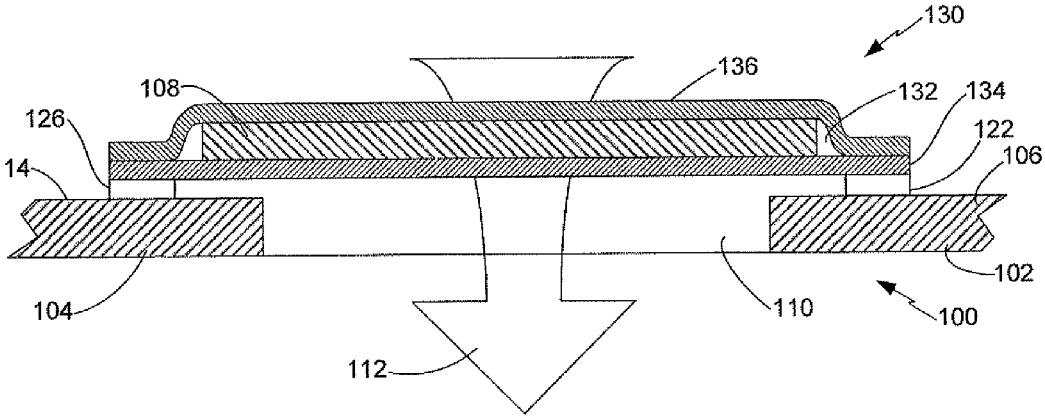

In accordance with another embodiment of the invention, the odor absorbing system 100 includes at least one breathable pocket 130 that is positioned at one of the vents 110 of the article of clothing 102, as shown in FIGS. 4A and 4B. The breathable pockets 130 are used to removably attach the odor absorbing inserts 108 to the article of clothing 102. FIG. 4A is a front plan view of an interior side 114 of the article of clothing 102 and FIG. 4B is a cross-sectional view of the system 100 taken generally along line 4B-4B of FIG. 4A.

Each breathable pocket 130 is preferably attached to a portion (e.g., an inside surface 114) of the base layer 106 at one of the vents 110. An odor absorbing insert 108 is contained in an interior chamber 132 of the breathable pocket. The breathable pocket 130 generally includes first and second layers of breathable material 134 and 136, respectively. The breathable material is preferably highly breathable such that it provides little resistance to an airflow 112 traveling through the vent 110. Examples of suitable breathable materials for use in forming the first and second layers 134 and 136 includes a mesh, a screen, and other highly breathable materials.

In accordance with one embodiment of the invention, the breathable pocket 130 is permanently mounted to the base layer 106. For example, the first and second layers 134 and 136 can be permanently mounted to the base layer 106 by sewing or gluing them to the base layer 106.

In accordance with another embodiment of the invention, the breathable pocket 130 is removably mounted to the base layer 106. For example, one or both of the layers 134 or 136 are removably mounted to the base layer 106 using suitable fasteners at the perimeter of the breathable pocket 130 such as those described above. Preferably, the first and second layers 134 and 136 of the breathable pocket 130 are permanently connected to each other and the fasteners are used to attach only one of the breathable layers to the base layer 106 at the perimeter of the vent 110. In accordance with this embodiment of the invention, the odor absorbing insert 108 could be non-removably contained in the breathable pocket 130, which is removably attached to the base layer 106 of the article of clothing 102.

Another embodiment of the breathable pocket 130 includes an opening 138 (FIG. 4A) through which the interior chamber 132 defined by the first and second layers 134 and 136 is accessible. The opening 138 can preferably be closed using a suitable fastener, such as those described above.

Additionally, the odor absorbing insert 108 is preferably sized to lay flat within the interior chamber 132 and may be configured to have a shape that substantially conforms to the shape of the interior chamber 132. As a result, the odor absorbing insert 108 can be designed for specific breathable pockets 130 and can be provided with different odor absorbing properties that are tailored to the location of the corresponding breathable pocket 130.

Additionally, the interior chamber 132 of the breathable pocket 130 is preferably only slightly larger in area than the odor absorbing insert 108 when both are laid flat, in order to accommodate the odor absorbing insert 108. Additionally, the interior chamber 132 of the breathable pocket 130 is preferably only slightly larger in volume than the odor absorbing insert 108. As a result, one embodiment of the breathable pocket 130 provides a snug fit for the odor absorbing insert 108. Such a snug fit allows the odor absorbing insert 108 to be held up against the perimeter of the vent 110 to thereby force most of the airflow 112 traveling through the vent 110 to travel through the odor absorbing insert 108 rather than around it.

One embodiment of the article of clothing 102 of the system 100 includes an upper body covering article of clothing 140, shown in FIG. 7. The base layer of the article of clothing 140 generally includes a torso section 142 and arm sections 144 that are attached to the torso section 142. The torso and arm sections 142 and 144 are respectively configured to substantially cover a torso and arms of the person wearing the article of clothing 140. One or more odor absorbing inserts 108 can be removably attached to the upper body article of clothing 140 using any of the methods described above and in the exemplary locations described below.

In accordance with one embodiment of upper body covering article of clothing 140, the base layer 106 includes vents 110 that are located at armpit sections 146 that are adjacent the torso and arm sections 142 and 144. Odor absorbing inserts 108 are positioned to cover the vents 110 at the armpit sections 146 of the base layer 106 such that they will be positioned at the armpits of the person wearing the article of clothing 140 to absorb odors at that primary odor-producing location.

In accordance with another embodiment of the upper body covering article of clothing 140, the vents 110 are located in shoulder sections 148 of the base layer 106. The shoulder sections 148 are adjacent a junction between the torso and arm sections 142 and 144. When the article of clothing 140 is worn by a person, the odor absorbing inserts 108 positioned at the vents 110 of the shoulder sections 148 of the base layer 106 will be positioned next to the shoulders of the person to absorb odors at that primary odor-producing location.

In accordance with yet another embodiment of the upper body covering article of clothing 140, a vent 110 is located below a neckline 150 of the torso section 142 of the base layer 106. When the article of clothing 140 is worn by a person, that vent 110 is positioned to overlay an upper back portion of the person when the vent 110 is located on a back side of the article of clothing 140, or an upper chest portion of the person when the vent 110 is located on a front side of the article of clothing 140. When the odor absorbing insert 108 covers the vent 110 it will be positioned at the upper chest and/or upper back of the person wearing the article of clothing 140.

Figure 6B:
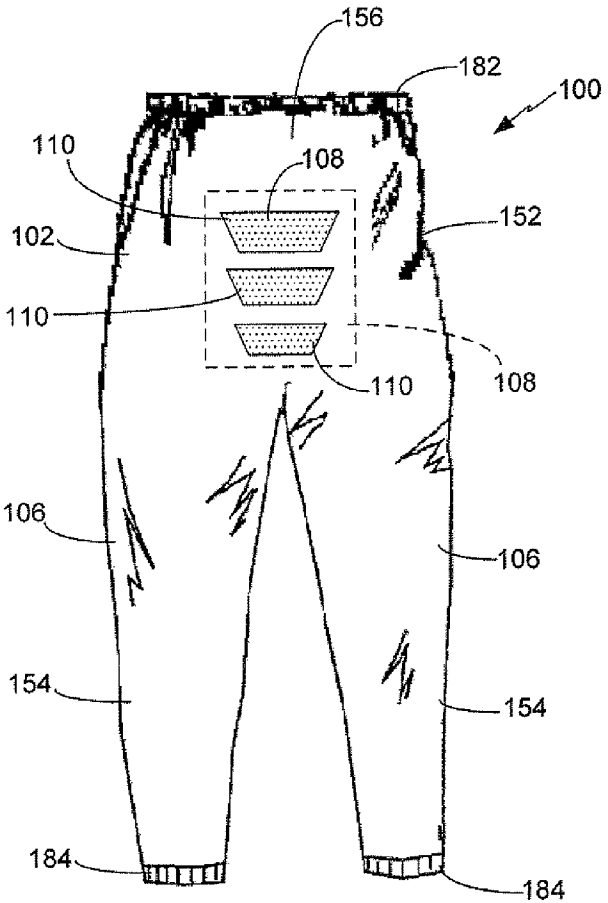
FIGS. 6A and 6B respectively are front and rear views of a lower body covering article of clothing of the odor absorbing system in accordance with embodiments of the invention.
Figure 6A:
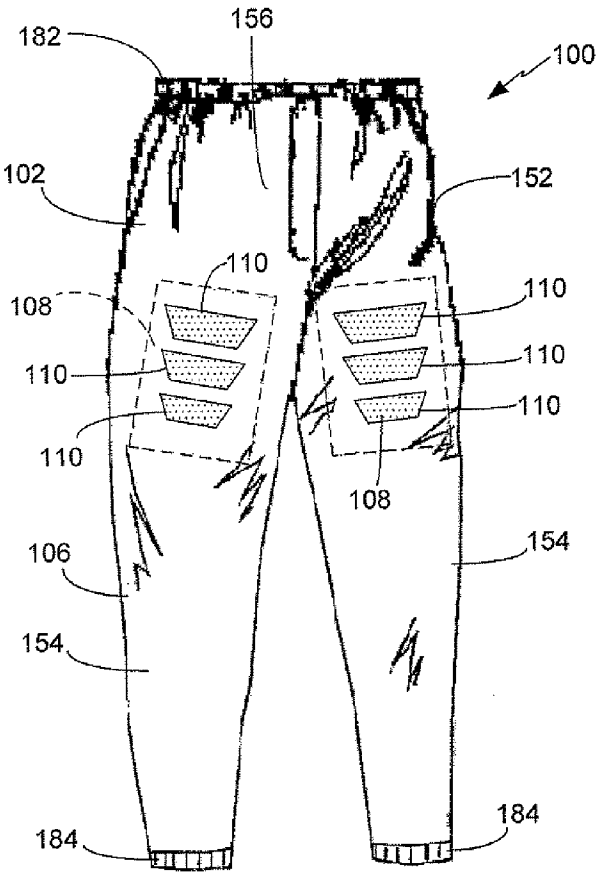

In accordance with another embodiment of the system 100, the article of clothing 102 includes a lower body covering article of clothing 152 shown in the front and back plan views of FIGS. 6A and 6B. The base layer 106 of the lower body covering article of clothing 152 includes pant leg sections 154 that are attached to a crotch section 156. The pant leg sections 154 are each configured to substantially surround the leg of the person wearing the article of clothing 152 and the crotch section 156 is configured to substantially surround a crotch area of the person. The leg sections 154 preferably extend substantially the entire length of the legs of the person, but could be configured to be shorter. In accordance with one embodiment of the lower body covering article of clothing 152, vents 110 are located in the pant leg sections 154 and/or in the crotch section 156 of the base layer 106. The odor absorbing inserts 108 can be removably attached to the lower body article of clothing 152 in these exemplary locations using any of the methods described above.

Figure 7B:
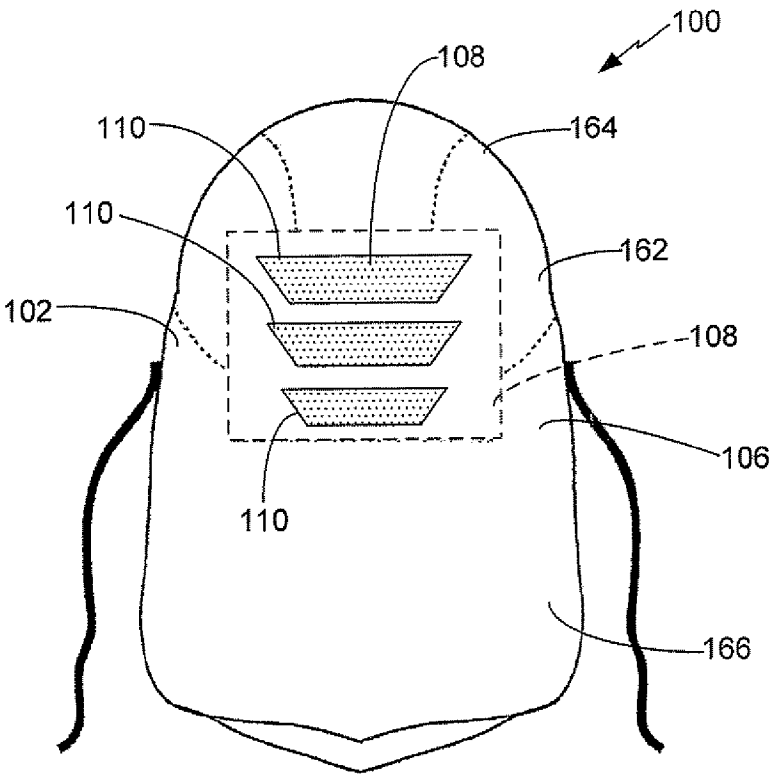
FIGS. 7A and 7B respectively are front and rear views of a head covering article of clothing of the odor absorbing system in accordance with embodiments of the invention.
Figure 7A:
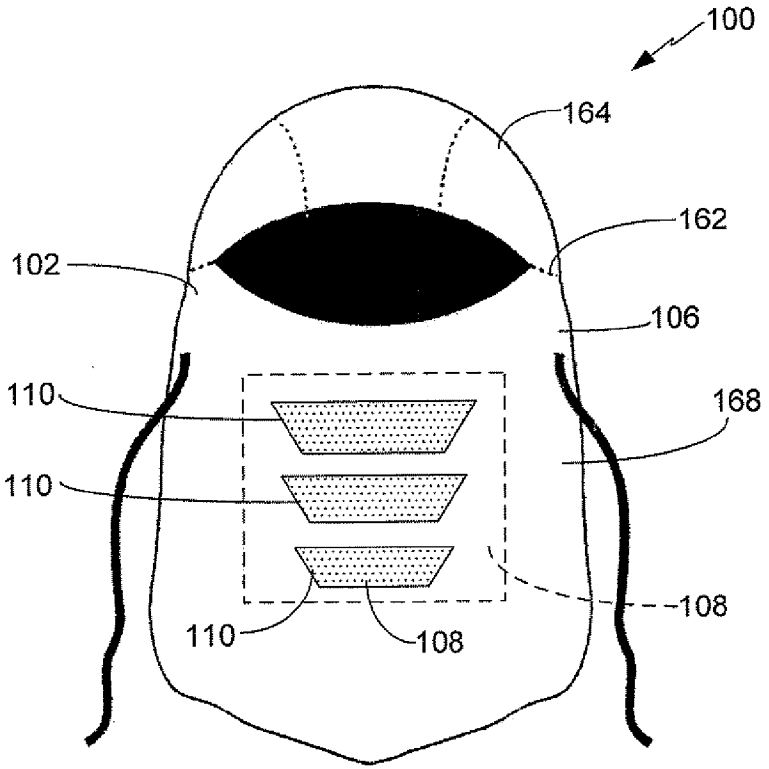

Another embodiment of the article of clothing 102 of odor absorbing system 100 includes a head covering article of clothing 162, front and back views of which are illustrated in FIGS. 7A and 7B. In accordance with one embodiment of the invention, the base layer 106 of the head covering article of clothing 162 includes at least a cap section 164 that is configured to cover a top of a head of the person. In accordance with additional embodiments of the invention, the base layer 106 of the head covering article of clothing 162 including a neck flap 166 (FIG. 7B) configured to overlay a neck of the person wearing the head covering 162, and/or a face cover 168 (FIG. 7A) configured to cover the mouth of the person wearing the head covering 162.

The vents 110 of the head covering article of clothing 162 can be located in the cap section 164 (FIG. 7B), the neck flap 166 (FIG. 7B), and/or the face cover 168 (FIG. 7A), and odor absorbing inserts 108 can be attached at the vents 110 using any of the methods described above. The vent 110 in the face cover 168 is preferably positioned at the mouth of the person wearing the article of clothing such that odors in the outgoing airflow in the form of a breath of the person are absorbed by the corresponding odor absorbing insert 108 at that location.

In accordance with another embodiment of the invention, the article of clothing 102 of the system 100 can also include airflow restriction components that are positioned at the primary openings of the article of clothing 102. Such airflow restriction components are configured to restrict airflows, particularly outgoing airflows from traveling through the primary openings (i.e., the neckline opening, the waistline opening, cuff openings, etc.) in the article of clothing 102 when the article of clothing is worn by a person. By creating such airflow restrictions at the primary openings, more of the outgoing airflows (e.g., airflow 112 shown in FIG. 1B) are directed through the vents 110 of the base layer 106 and the odor absorbing inserts 108 covering the vents 110 to further reduce odor emanation from the person wearing the article of clothing. In accordance with one embodiment of the invention, the base layer 106 is formed of a substantially non-breathable material, which further improves the ability of the system 100 to direct the outgoing airflows 112 through the vents 110 and the odor absorbing inserts 108.

Embodiments of the upper body covering article of clothing 140 include airflow restriction components such as a neckline 170, a waistline 172, and cuffs 174. The neckline 170 is attached to the torso section 142 of the base layer 106 and is configured to squeeze a neck of the person wearing the article of clothing. In other words, the neckline 170 is configured to generate an airflow restrictive seal at the neck of the person that operates to restrict airflow from the interior side of the article of clothing 142 through the primary opening 176 at the neck of the person.

The waistline 172 is attached to the torso section 142 of the base layer 106 and is configured to squeeze a waist of the person wearing the article of clothing 140 to thereby restrict airflow from an interior side of the article of clothing 140 through the primary opening (not shown) at the waist of the person.

Likewise, the cuffs 174 are each attached to an end of one of the arm sections 144 of the base layer 106 and are configured to squeeze a wrist of the person wearing the article of clothing 140 to thereby restrict airflow from an interior side of the article of clothing through the primary openings 178 at the wrists of the person. Each of the airflow restriction components can include an elastic band, a drawstring, or other suitable component, generally indicated at 180, to facilitate the body squeezing function.

One embodiment of the lower body covering article of clothing 152 includes airflow restriction components in the form of a waistline 182 and cuffs 184, shown in FIGS. 6A and 6B. The waistline 182 is attached to the crotch section 156 of the base layer 106 and is configured to squeeze a waist of the person wearing the article of clothing 152 to thereby restrict airflow from an interior side of the article of clothing through the primary opening at the waist of the person. The cuffs 184 are attached at ends of the leg sections 154 of the base layer 106 and are configured to squeeze ankles of the person wearing the article of clothing 152 to thereby restrict airflow from an interior side of the article of clothing through the primary openings at the ankles of the person. The waistline and cuff airflow restriction components 182 and 184 can include elastic bands and/or drawstrings to facilitate the squeezing function as mentioned above.

Additional embodiments of the odor absorbing system 100 of the present invention are based on a recognition that odor absorbing materials have a limited useful odor absorbing lifespan. In fact, as the odor absorbing material absorbs odors, the rate of odor absorption and the remaining amount of odor that the material will be able to absorb decreases. Additionally, odor absorbing materials, such as activated carbon, have odor absorbing properties that cannot be renewed by washing, for instance.

One advantage to the odor absorbing inserts 108 of the present invention is that they can be removed and replaced as needed while maintaining use of the article of clothing 102. As a result, the system 100 of the present invention avoids the problems of prior art odor absorbing articles of clothing that directly bond the odor absorbing material to the base layer that forms the article of clothing, which must be completely replaced periodically in order to maintain a desired odor absorbing performance.

Figure 8:
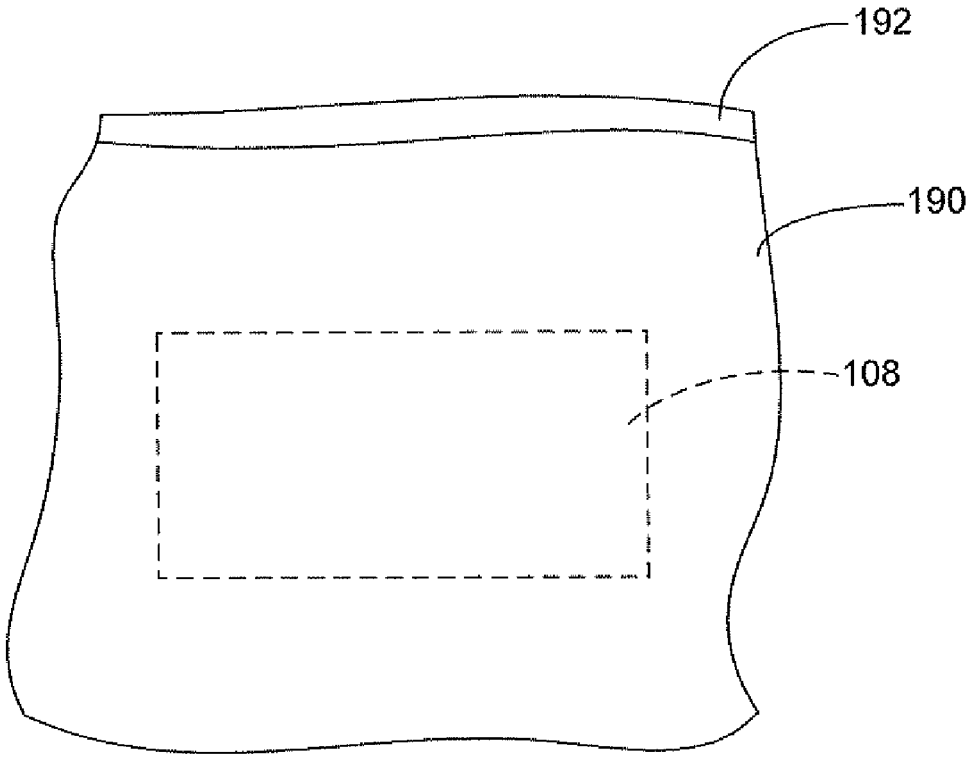
FIG. 8 is a simplified front plan view of a sealable container containing a scent absorbing insert in accordance with embodiments of the invention.

In accordance with one embodiment of the odor absorbing system 100, the odor absorbing insert 108 is stored in a sealed container 190, such as a sealed bag (e.g., a foil bag, or pouch) as illustrated in FIG. 8, a plastic container, or other container that reduces the exposure of the insert to odors. Preferably, the sealed container 190 includes a reusable seal 192, to allow the user of the system 100 to place the scent absorbing insert 108 back in the sealed container 190 during periods of nonuse. In this manner, the scent absorbing insert 108 of the present invention can maintain its odor absorbing properties over longer periods of time as compared to prior art articles of clothing that are generally continuously exposed to environmental odors (even when stored during periods of nonuse), to thereby extend its useful odor absorbing lifespan. Thus, the system 100 also includes a kit that includes the odor absorbing insert in the sealed package 190 and the article of clothing 102.

Figure 5:
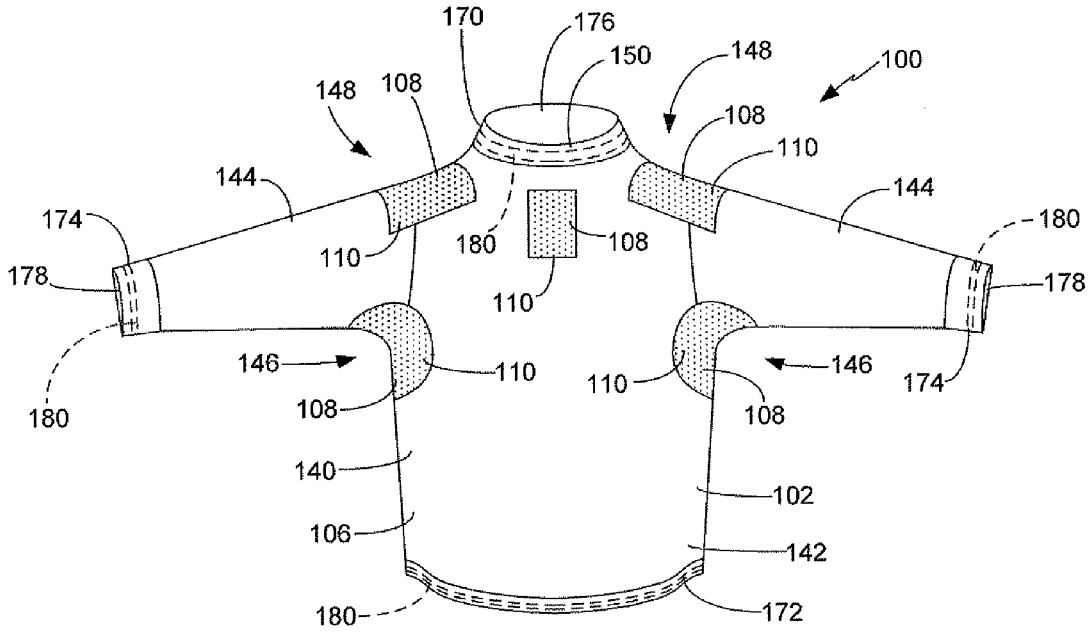
FIG. 5 is a front view of an upper body covering article of clothing of the odor absorbing system in accordance with embodiments of the invention.
Figure 9:
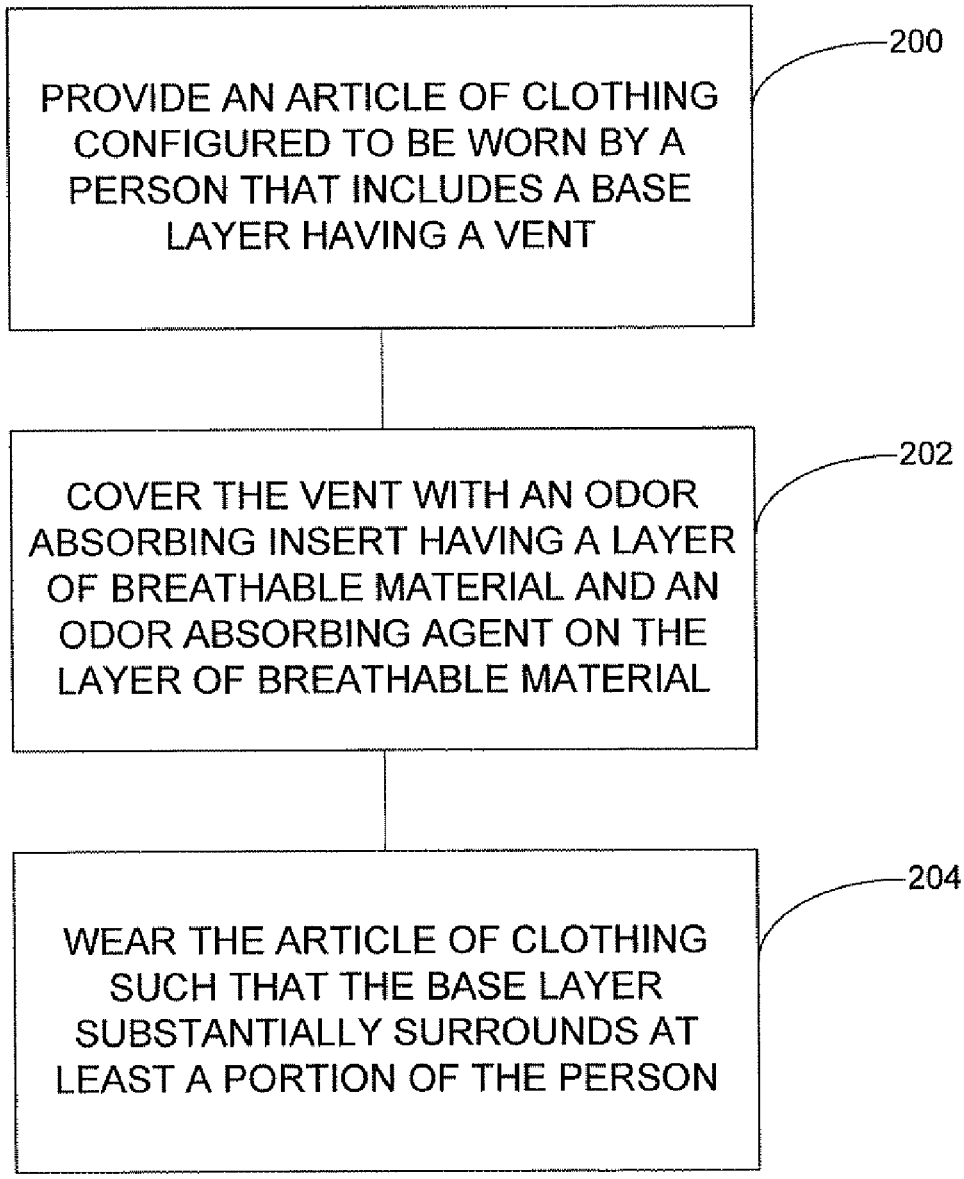
FIG. 9 is a flowchart illustrating a method of using an odor absorbing system in accordance with embodiments of the invention.

One aspect of the present invention is directed to a method of using the odor absorbing system 100 described above to reduce odor emanation from a person into an environment surrounding the person. Steps of the method are illustrated in the flowchart of FIG. 9. At step 200, an article of clothing 102, such as an upper body covering article of clothing 140 (FIG. 5), a lower body covering article of clothing 152 (FIGS. 6A and 6B), and/or a head covering article of clothing 162 (FIGS. 7A and 8A), is provided, which is configured to be worn by a person. The article of clothing 102 includes a base layer 106 having a vent 110. Next, at step 202, the vent 110 is covered with an odor absorbing insert 108 having a layer of breathable material 118 and an odor absorbing agent 120 on the layer of breathable material 118, as shown in FIG. 3. Finally, at step 204, the article of clothing 102 is worn by the person such that the base layer 106 substantially surrounds at least a portion of the person. As a result, outgoing airflows 112 from an interior side 114 of the base layer 106 are directed through the vent 110 and the odor absorbing insert 108, which removes odors in the airflow, to thereby reduce odor emanation from the person into the surrounding environment, as shown in FIG. 1B.

In accordance with one embodiment of the method, the odor absorbing insert 108 is provided in a sealed container or package 190, as described above and the user removes the odor absorbing insert 108 from the sealed package 190 prior to covering the vent 110 in step 202.

In accordance with yet another embodiment of the invention, the method includes performing an outdoor activity, such as hunting wildlife, while wearing the article of clothing with the odor absorbing insert positioned at the vent.

In accordance with one embodiment of the invention, the layer of breathable material 118 of the scent absorbing insert 108 and/or the base layer 106 of the article of clothing 102 includes an anti-microbial fabric having an anti-microbial agent. Such anti-microbial fabrics are available from a number of sources including Sherman Textile Company of Dallas, N.C.; Magna Fabrics of North Bergen, N.J.; and Microban® Products Company of Huntersville, N.C. A preferred anti-microbial fabric is the Microsafe® fabric produced by Microban® Products Company.

Figure 10:
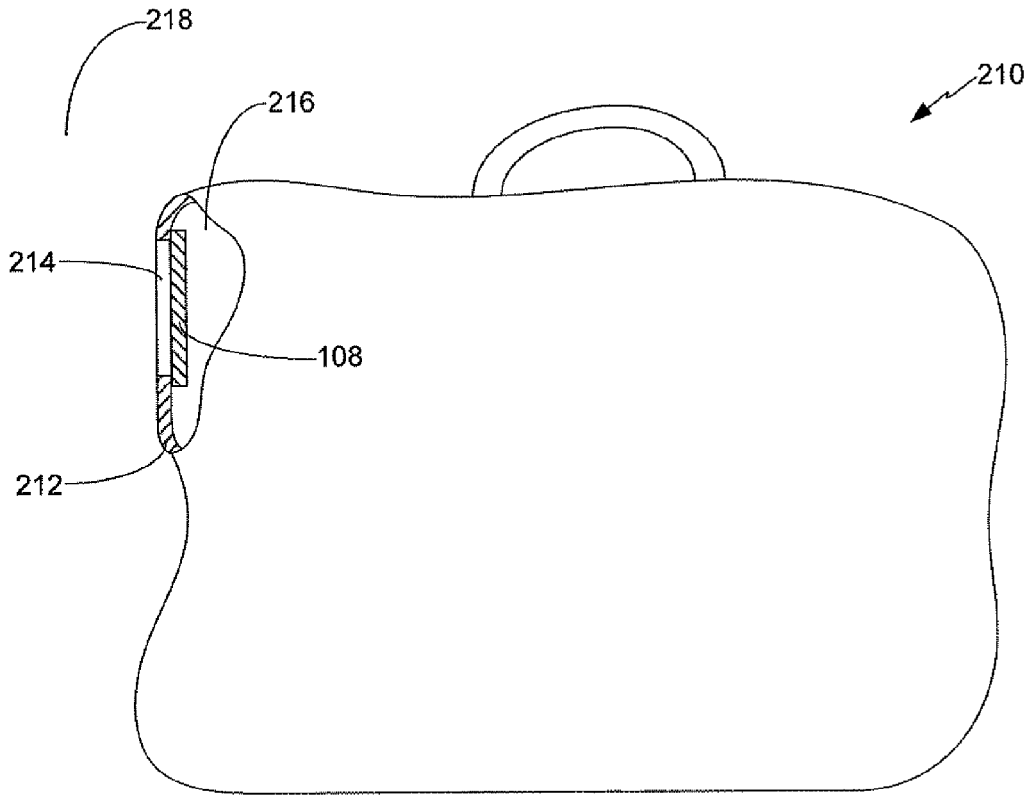
FIG. 10 is a simplified illustration of a duffel bag in partial cross section in accordance with embodiments of the invention.

Additional embodiments of the present invention are directed to the application of the odor absorbing system to items other than articles of clothing where odor absorption is desired. Such items include containers, such as shoe bags, duffel bags, luggage, laundry bags, and other types of containers. FIG. 10 is a simplified illustration of a duffel bag 210 in partial cross-section in accordance with this embodiment of the invention. In general, the duffel bag 210 is primarily constructed of an outer layer of material 212 that is preferably substantially non-breathable. A vent 214 is formed in the outer layer of material to provide an airflow path between an interior chamber 216 of the duffel bag and the outside environment 218. A scent absorbing insert 108 is positioned to cover the vent 214 to force the airflow to flow through the odor absorbing insert 108. The odor absorbing insert 108 is preferably removably attached to the layer 212 using any of the methods described above.

Although the present invention has been described with reference to preferred embodiments, workers skilled in the art will recognize that changes may be made in form and detail without departing from the spirit and scope of the invention.

What is claimed is:

1. An odor absorbing system comprising:

a head covering article of clothing configured to be worn by a person including a base layer comprising a cap section configured to substantially cover a head of the person wearing the article of clothing, and a plurality of vents, wherein the base layer is formed of a material that is less breathable than the vents;

a plurality of fasteners; and a plurality of odor absorbing inserts removably attachable to the article of clothing adjacent the vents using the fasteners, each insert including a layer of breathable material and an odor absorbing agent on the layer of breathable material.

2. The system of claim 1, wherein the base layer comprises a neck covering portion configured to overlay a neck of the person wearing the article of clothing.

3. The system of claim 2, wherein the neck covering portion of the base layer includes one of the vents.

4. The system of claim 1, wherein the base layer comprises a face covering portion configured to cover a mouth of the person wearing the article of clothing.

5. The system of claim 4, wherein the face covering portion of the base layer includes one of the vents.

6. The system of claim 5, wherein the vent is configured such that the vent is positioned at the mouth of the person wearing the article of clothing.

7. The system of claim 1, wherein the plurality of vents comprise a first vent positioned on a first side of the article of clothing and a second vent positioned on a second side of the article of clothing that opposes the first side.

8. The system of claim 7, wherein the first vent is configured such that the first vent is positioned at a mouth of the person wearing the article of clothing.

9. The system of claim 1, wherein each fastener comprises a breathable pocket including first and second layers of breathable materials spanning one of the vents and defining an interior chamber, wherein each of the odor absorbing inserts is removably receivable within one of the interior chambers of the breathable pockets.

10. The system of claim 9, wherein the odor absorbing inserts are each removably contained within the interior chamber of one of the breathable pockets.

11. The system of claim 1, wherein the odor absorbing agent is selected from a group consisting of activated carbon, charcoal, chlorophyll, baking soda, activated alumni, soda, lime, zeolite, calcium oxide, potassium permanganate, and cyclodextrin.

12. An odor absorbing system comprising:

a head covering article of clothing configured to be worn by a person, wherein the head covering article of clothing comprises:

a head base layer comprising a cap section configured to substantially cover the head of the person wearing the head covering article of clothing; and a first odor absorbing insert removably attachable to the head covering article of clothing, the first odor absorbing insert including an odor absorbing agent; and an upper body covering article of clothing configured to be worn by a person, wherein the upper body covering article of clothing comprises:

an upper base layer comprising a torso section and arm sections each connected to the torso section, the torso and arm sections respectively configured to substantially cover the torso and arms of the person wearing the upper body covering article of clothing; and a second odor absorbing insert removably attachable to the upper body covering article of clothing, the second odor absorbing insert including an odor absorbing agent.

13. The system of claim 12, wherein the head base layer comprises a first vent and the head base layer is formed of a material that is less breathable than the first vent;

the first odor absorbing insert comprises a layer of breathable material, which is removably attachable to the head covering article of clothing adjacent the first vent using a first fastener;

the upper base layer comprises a second vent and the upper base layer is formed of a material that is less breathable than the second vent; and the second odor absorbing insert comprises a layer of breathable material, which is removably attachable to the upper body covering article of clothing adjacent the second vent using a second fastener.

14. The system of claim 13 wherein the first fastener includes a breathable pocket attached to the head base layer adjacent the first vent, the breathable pocket including first and second layers of breathable material spanning the first vent and defining an interior chamber, wherein the first odor absorbing insert is removably receivable within the interior chamber.

15. The system of claim 13 wherein the second fastener includes a breathable pocket attached to the upper base layer adjacent the second vent, the breathable pocket including first and second layers of breathable material spanning the second vent and defining an interior chamber, wherein the second odor absorbing insert is removably receivable within the interior chamber.

16. A head covering article of clothing comprising:

a base layer comprising a cap section configured to substantially cover a head of the person wearing the article of clothing, and a plurality of vents, wherein the base layer is formed of a material that is less breathable than the vents and comprises a neck covering portion configured to overlay a neck of the person wearing the article of clothing, the neck covering portion including one of the vents; and a plurality of odor absorbing inserts attached to the article of clothing adjacent the vents, each insert including a layer of breathable material and an odor absorbing agent on the layer of breathable material.

17. The article of clothing of claim 16, wherein the odor absorbing inserts cover the vents.

18. The article of clothing of claim 16, wherein the base layer comprises a face covering portion configured to cover a mouth of the person wearing the article of clothing, the face covering portion including one of the vents; and one of the odor absorbing inserts is attached to the article of clothing adjacent the vent in the face covering portion.

19. The article of clothing of claim 16, wherein the odor absorbing agent is selected from a group consisting of activated carbon, charcoal, chlorophyll, baking soda, activated alumni, soda, lime, zeolite, calcium oxide, potassium permanganate, and cyclodextrin.

* * * * *